United States Patent [19]

Keller et al.

[11] 4,086,973

[45] May 2, 1978

[54] ASYMMETRIC INSERT FOR INNER ROW OF AN EARTH BORING CUTTER

[75] Inventors: Wilbur S. Keller, Arlington; James Wilson Langford, Jr., Red Oak, both of Tex.

[73] Assignee: Dresser Industries, Inc., Dallas, Tex.

[21] Appl. No.: 747,446

[22] Filed: Dec. 3, 1976

[51] Int. Cl.[2] ..... E21B 9/08

[52] U.S. Cl. ..... 175/374; 175/410

[58] Field of Search ..... 175/374, 410, 398, 399, 175/400

[56] References Cited

U.S. PATENT DOCUMENTS

| | | | |
|---|---|---|---|
| 2,579,268 | 12/1951 | Malherbe | 175/400 X |
| 3,388,757 | 6/1968 | Fittinger | 175/410 |
| 3,389,761 | 6/1968 | Ott | 175/410 |
| 3,442,342 | 5/1969 | McElya et al. | 175/374 |
| 3,599,737 | 8/1971 | Fischer | 175/374 |
| 3,734,213 | 5/1973 | Goodfellow | 175/374 |
| 3,858,670 | 1/1975 | Ott | 175/374 |

FOREIGN PATENT DOCUMENTS

| | | | |
|---|---|---|---|
| 302,104 | 7/1968 | Sweden | 175/410 |

*Primary Examiner*—Ernest R. Purser
*Assistant Examiner*—Richard E. Favreau
*Attorney, Agent, or Firm*—Eddie E. Scott

[57] ABSTRACT

An asymmetric insert has a formation contacting crest thereby decreasing the loading on the insert and increasing the lifetime of the cutter. The insert has a shape prior to assembly in the cutter that includes a base integrally joined to an asymmetric head. The base is mounted in a socket in the cutter body. The head projects from the surface of the cutter and includes a crest positioned to contact the formations with substantially its entire length.

2 Claims, 4 Drawing Figures

ASYMMETRIC INSERT FOR INNER ROW OF AN EARTH BORING CUTTER

BACKGROUND OF THE INVENTION

The present invention relates in general to the art of earth boring and more particularly to a cutting element for an earth boring cutter.

Earth boring cutters have hard insert elements mounted in a cutter member body utilized in the boring of holes in the earth. The hard insert cutting elements have the ability to penetrate earth formations. In prior art cutters the length of the crest of the insert has been normal to the axis of the insert. The inner row inserts are in contact with the formation and, therefore, loaded highest on the outermost corner radius that is formed by the intersection of the crest and the outer side. This unbalanced unit loading on the insert may be sufficiently high to cause breakage. The cyclic loading due to cutter rotation imposes high unit loading on the corner radius, thereby promoting early fatigue failure.

BRIEF DESCRIPTION OF PRIOR ART

In U.S. Pat. No. 3,442,342 to F. H. McElya and R. A. Cunningham patented May 6, 1969, a specially shaped insert for compact rock bits and rolling cutters and rock bits using such inserts is shown. The original inserts of cemented tungsten carbide had hemispherical cutting tips, and rock bits using such inserts were used to drill the hardest abrasive formations, such as taconite, bromide, and chert. This shape is not particularly effective for the drilling of abrasive formations of medium hardness, e.g., hard shales, dolomite, and some limestones, and the inventors herein have developed inserts with more of a chisel or wedge shape to cut such rock. At the same time, they avoid the pitfalls of the "roof-top" style of cutting tip, one in which there are two flanks with flat surfaces converging to a flat crest.

Two basic shapes of cutting tips are disclosed: (1) a modified chisel with convex flanks converging to a crest which is convex along both its elongated lengths and its uniform narrow width, the flanks being normal to a common plane passing through the axis of the insert so that their projected intersection is a curve normal to such axis; and (2) a wedge shape in which the flanks are twisted or canted away from each other so that there is no single plane through the insert axis which is normal to both flanks and the projected intersection is not normal to the axis, the result being that the crest formed normal to the axis increases in width from one end to the other.

In all forms rounded intersections are provided to avoid the sharp corners and sharp edges which cause high-stress concentration. The inventor's theory is that their rounding and their convex surfaces distribute the operating load over the cutting edge of the insert and direct such load to the center of the insert, thus avoiding the high stress at the edges which they believe to be responsible for the chipping and breaking of roof-top inserts.

In U.S. Pat. No. 2,774,570 to R. A. Cunningham patented Dec. 18, 1956, a roller cutter for earth drills is shown. The rolling cutter includes an annular series of cylindrical inserts of hard wear-resistant material having their axes extending outwardly and substantially normal to the surface of the body and presenting protrusions at the surface thereof to affect disintegrating action and to maintain gage of the well bore being drilled.

SUMMARY OF THE INVENTION

The present invention retards breakage of inserts and increases insert life, especially in the inner rows, by reducing the point loading that prior art insert shapes incur. The length of the crest of the insert of the present invention is not normal to the axis of the insert. When placed in an inner row position, the crest will contact the formation over the entire length of the crest. The loading from the formation is distributed over the length of the crest and not concentrated on the corner radius of the crest. The above and other features and advantages of the present invention will become apparent from a consideration of the following detailed description of the invention when taken in conjunction with the accompanying drawings.

DETAILED DESCRIPTION OF THE INVENTION

Figure 1:
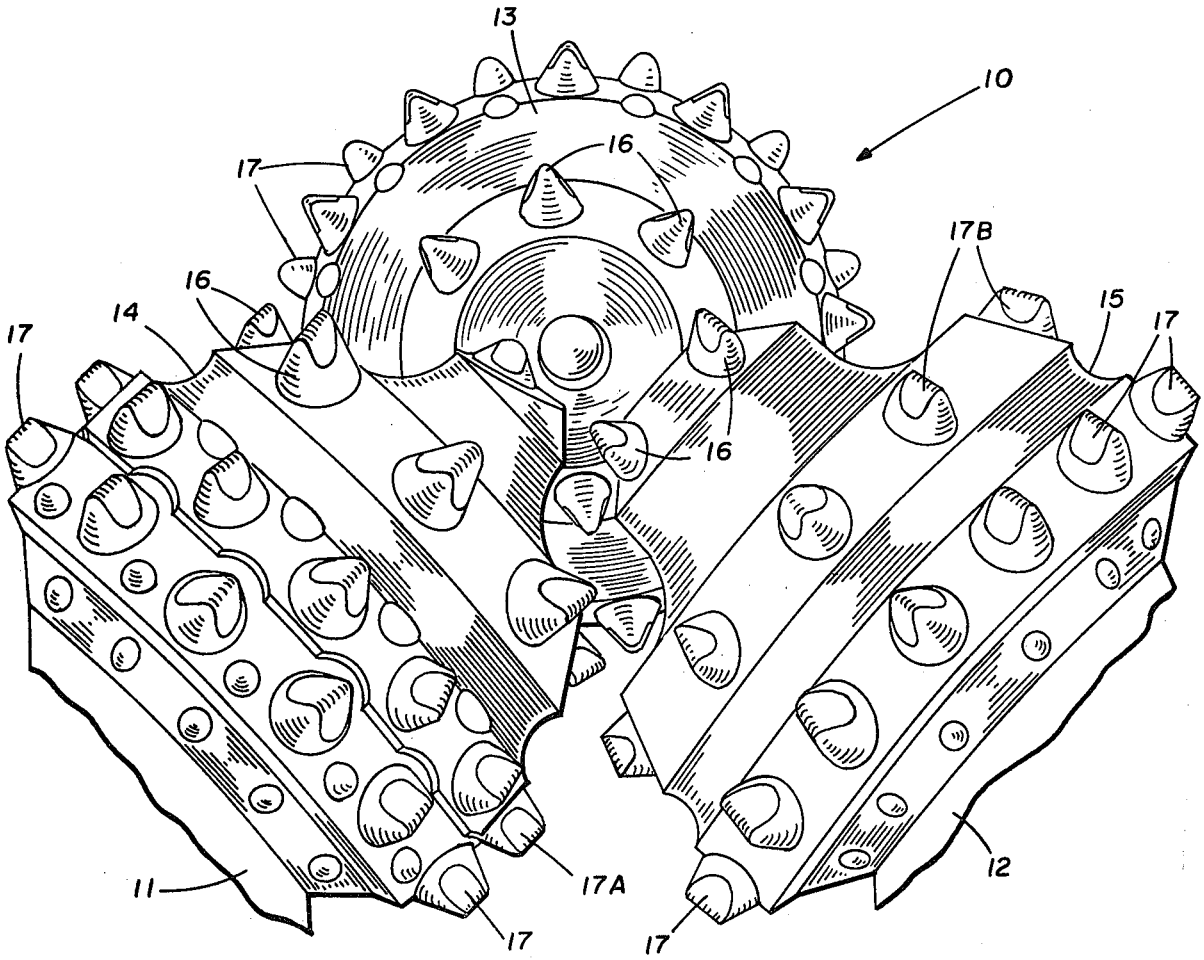
FIG. 1 is a cut-away perspective illustration of a three-cone rolling cutter rock bit embodying the present invention.

Referring now to the drawings and to FIG. 1 in particular, a rotary rock bit generally designated by the reference character 10 embodying the present invention is illustrated. The bit 10 includes a bit body adapted to be connected at its pin end to the lower end of a rotary drill string (not shown). The bit body includes a passage providing communication for drilling muds or the like passing downwardly through the drill string to allow the drilling mud to be directed to the bottom of the well bore and pass upward in the annulus between the wall of the well bore and the drill pipe carrying cuttings and drilling debris therewith.

Depending from the body of the bit are three substantially identical arms. Arms 11 and 12 are shown in FIG. 1. The lower end portion of each of the arms is provided with a conventional bearing pin. Each arm rotatably supports a generally conical cutter member. The cutter members are designated 13, 14, and 15 in FIG. 1. The bearing pins carrying the cutting members 13, 14, and 15 define axes of rotation respectively about which the cutter members rotate. The axes of rotation are tilted downwardly and inwardly at an angle.

Each of the cutter members 13, 14, and 15 includes a nose portion that is oriented toward the bit axis of rotation and a base that is positioned at the intersection between the wall of the well bore and the bottom thereof. Each of the cutter members 13, 14, and 15 includes an annular row of inserts 17 located adjacent the base of each cutting member. The row of inserts 17 cut the intersection between the well bore wall and the bottom thereof. The cutter member 14 includes a row of symetric inserts 17A immediately adjacent the row of inserts 17 and the cutter 15 includes a row of symetric inserts 17B spaced from the row of inserts 17. Each of the cutter members 13, 14, and 15 includes at least one annular inner row of inserts 16 for destroying the inner portion of the hole. The present invention affords a greater length of formation contacting crest for the inner row inserts 16. This decreases the loading on the inner row inserts, therefore increasing the lifetime of the bit. Applicant has provided an insert which contacts the formations with the majority of the length of the extended crest surface.

Figure 2:
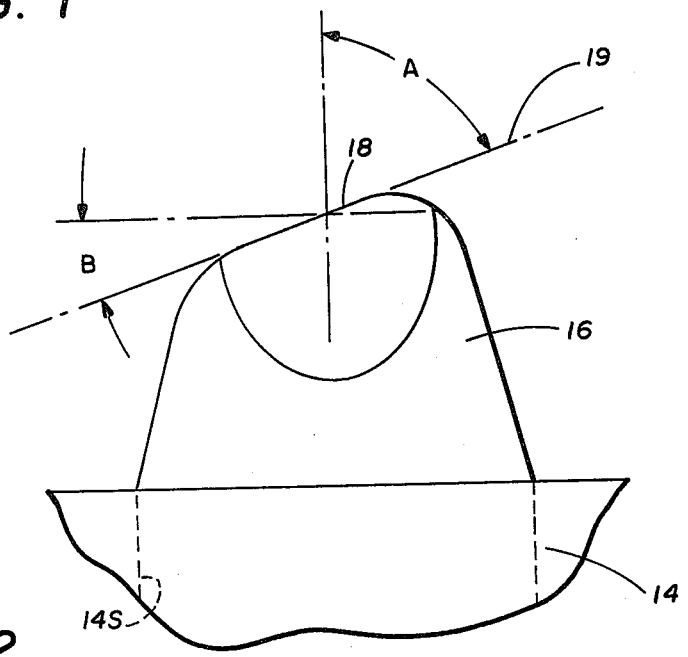
FIG. 2 is an enlarged side view illustration of an inner row insert of the bit shown in FIG. 1.

Referring now to FIG. 2, a side view of one of the inner row inserts 16 is shown enlarged and in greater detail. The insert 16 is formed by pressing granules of a wear-resistant material such as tungsten carbide together with granules of a binder such as cobalt. The wear-resistant material granules and binder granules are pressed together with wax and formed in the desired insert shape. The head of the insert may be formed in a die. For example, the head of the insert 16 may be formed by a punch member which molds the end of the insert into the desired finished shape. The inserts are de-waxed in a furnace and sintered at a higher temperature in a furnace. The insert 16 is then press-fitted into socket 14S in the body of the cutter member with the asymmetric head oriented so that the extended crest 18 of the insert 16 and the axis of rotation of the cutter lie in a common plane. This aligns the extended crest on the cone cutter in a position to provide optimum action on the formations. The extended crest 18 of the insert 16 is not normal to the axis of the insert 16. When placed in an inner row position, the crest 18 will contact the formations over the entire length of the crest 18. The loading from the formation is distributed over the length of the crest 18 and not entirely on the corner radius of the crest.

The present invention retards breakage of the inner row inserts and increases fatigue life by reducing the point loading that prior art inserts incur. The insert 16 is basically a tooth shaped insert with the angle A formed by the length of the crest 18 and the axis of the insert 16 being between 60° and 85°. The angle B between a line normal to the axis of insert 16 and the crest 18 is between 5° and 30°. The extended length of the crest 18 of the insert 16 will contact the formations 19 and the point loading that would be encountered with a symmetrical insert is avoided.

The foregoing should be contrasted with prior art inserts. The prior art inserts are in contact with the formations loaded only on the outermost corner radius that is formed by the intersection of the crest and the outer side. This unbalanced unit loading on the prior art inserts may be sufficiently high to cause breakage. The cyclic loading due to the cone rotation imposes high unit loading on the corner radius, thereby promoting early fatigue failure.

Figure 3:
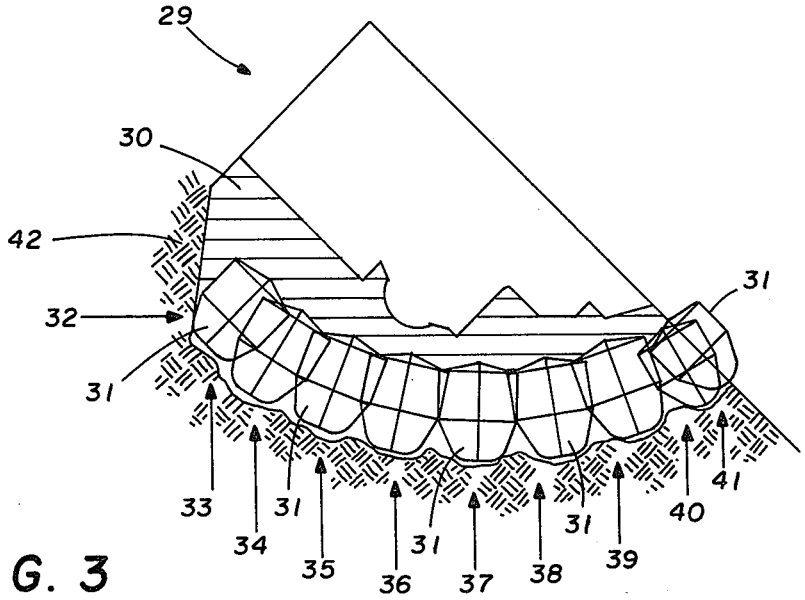
FIG. 3 PRIOR ART
FIG. 3 is an illustration of superimposed cutters of a prior art three-cone rolling cutter rock bit.

Referring now to FIG. 3, a superimposed view of three cutters of a prior art earth boring bit 29 is illustrated demonstrating the load concentration on the inserts 31. A composite of the lower portion of the three cutter members 30 of the prior art three cone rock bit 29 is shown illustrating the coverage of the well bore bottom by the annular rows of inserts 31 located in the cutter members 30. The prior art earth boring bit contacts the formations 42 to form a borehole therethrough by action of the inserts 31 on the bottom of the borehole. As the bit 29 is rotated, the inserts 31 projecting from the respective cone shells 30 contact the formations 42 causing portions of the formation to break away. The formation debris is flushed from the borehole by the circulating drilling fluid. The loading on the inserts is not uniform because of the angle of contact between the inserts and the formations 42. The arrows 32–41 represent the area of highest loading on each of the individual inserts 31. It will be noted that the inserts near the middle of the cones 30 are loaded near the central axis of the inserts resulting in nearly uniform loading whereas the inserts near each end of the cone cutters 30 are loaded by the highest concentration of loading being spaced from the central axis of the inserts. It will be noted that in the prior art bit 29 the length of the crest of each insert is normal to the axis of the insert and that the inserts 31 are loaded highest toward the outermost corner radius. This unbalanced unit loading on the inserts may be sufficient to cause breakage. The cyclic loading due to cutter rotation imposes high unit loading on the corner radius thereby promoting early fatigue failure.

Figure 4:
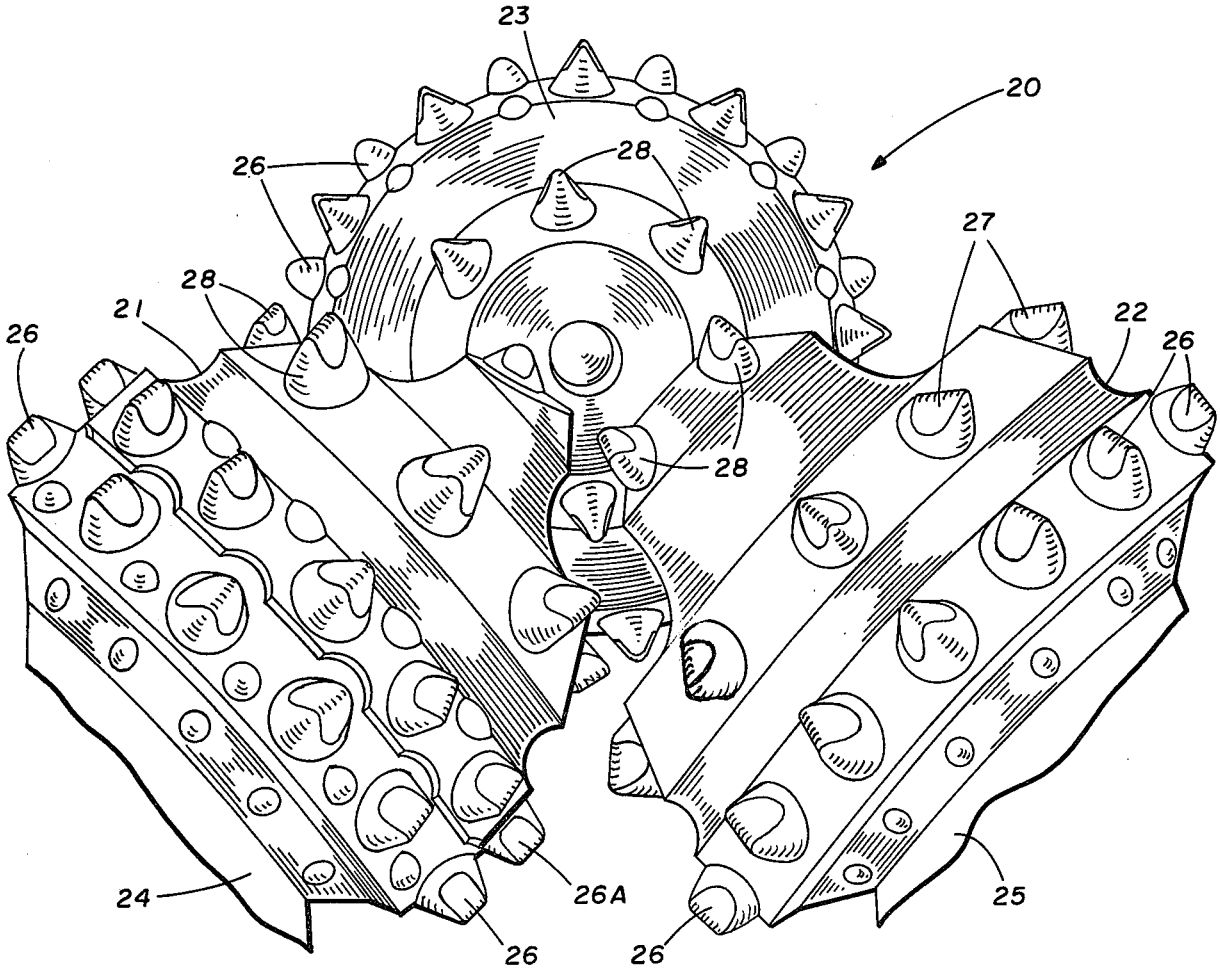
FIG. 4 is an illustration of another embodiment of a three-cone rolling cutter rock bit embodying the present invention.

Referring now to FIG. 4, a rotary rock bit generally designated by the reference character 20 embodying another embodiment of the present invention is illustrated. The bit 20 includes a bit body adapted to be connected at its pin end to the lower end of a rotary drill string (not shown). The bit body includes a passage providing communication for drilling muds or the like passing downwardly through the drill string to allow the drilling mud to be directed to the bottom of the well bore and pass upward in the annulus between the wall of the well bore and the drill pipe carrying cuttings and drilling debris therewith.

Depending from the body of the bit are three substantially identical arms. Arms 24 and 25 are shown in FIG. 4. The lower end portion of each of the arms is provided with a conventional bearing pin. Each arm rotatably supports a generally conical cutter member. The cutter members are designated 21, 22, and 23 in FIG. 4. The bearing pins carrying the cutting members 21, 22, and 23 define axes of rotation respectively about which the cutter members rotate. The axes of rotation are tilted downwardly and inwardly at an angle.

Each of the cutter members 21, 22, and 23 includes a nose portion that is oriented toward the bit axis of rotation and a base that is positioned at the intersection between the wall of the well bore and the bottom thereof. Each of the cutter members 21, 22, and 23 includes an annular row of inserts 26 located adjacent the base of each cutting member. The row of inserts 26 cut the intersection between the well bore wall and the bottom thereof. The cutter member 21 includes a row of symetric inserts 26A immediately adjacent the row of inserts 26. Each of the cutter members 21, 22, and 23 includes at least one annular inner row of inserts for destroying the inner portion of the hole. The present invention affords a greater length of formation contacting crest for the inner row inserts. This decreases the loading on the inner row inserts, therefore increasing the lifetime of the bit. Applicant has provided an insert which contacts the formations with the majority of the length of the extended crest surface. The inserts are formed by pressing granules of a wear-resistant material such as tungsten carbide together with granules of a binder such as cobalt. The wear-resistant material granules and binder granules are pressed together with wax and formed in the desired insert shape. The head of the inserts may be formed in a die. For example, the heads of the inserts may be formed by a punch member which molds the end of the insert into the desired finished shape. The inserts are de-waxed in a furnace and sintered at a higher temperature in a furnace. The inserts are then press-fit into the cutters 21, 22, and 23 with the formation contacting head oriented as desired.

As shown in FIG. 4, the inner row of inserts 27 have been press-fitted into the body of the cutter member 22 with the asymmetric heads oriented so that each individual extended crest of the inserts 27 and the axis of rotation of the cutter 25 lie in a common plane. This aligns the extended crests on the cone cutter 22 in a position to provide optimum action on the formations. The extended crests of the insert 27 are not normal to the axes of the insert 27. The loading on the insert is more uniform than in the prior art inserts shown in FIG. 3. The loading from the formation is distributed over the length of the crest 18 and not entirely on the corner radius of the crest.

Each of the cutter members 21, 22, and 23 includes at least one annular inner row of inserts 28 for destroying the innermost portion of the hole. The present invention affords a greater length of formation contacting crest for the inner row inserts 28. This decreases the loading on the inner row inserts, therefore increasing the lifetime of the bit. Applicant has provided inserts which contact the formations with the majority of the length of the extended crest surface. The inserts 28 are press-fitted into the body of the cutter members 21, 22, and 23 with the asymmetric heads oriented so that each individual extended crest and the axis of rotation of the cutter lie in a common plane. This aligns the extended crests on the cone cutters in a position to provide optimum action on the formations. The extended crests of the inserts are not normal to the axes of the inserts. When placed in the inner row position, the crests will contact the formations over the entire length of the crests. The loading from the formation is distributed over the length of the crests and not concentrated heavily on the corner radius of the crests.

The foregoing should be contrasted with prior art inserts. The prior art inserts are in contact with the formations loaded only on the outermost corner radius that is formed by the intersection of the crest and the outer side. This unbalanced unit loading on the prior art inserts may be sufficiently high to cause breakage. The cyclic loading due to the cone rotation imposes high unit loading on the corner radius, thereby promoting early fatigue failure.

The embodiments of the invention in which an exclusive property or privilege is claimed are defined as follows:

1. In a rotary rock bit having at least one rolling cutter member for forming a borehole in the earth, said rolling cutter member having at least one annular inner row of inserts mounted in sockets in the cutter member for cutting the inner portions of the borehole, the improvement comprising:

said inserts having an asymmetric shape prior to assembly in the sockets that includes extended formation contacting crests said crests being substantially parallel to the inner portions of the borehole being cut and extending at acute angles to the axes of said inserts.

2. In an earth boring bit having a rolling cone cutter for forming an earth borehole by disintegrating earth formations, said rolling cutter having a nose and a cone base with at least one inner annular row of inserts between said nose and said base mounted in sockets in the rolling cone cutter, said inserts having a central axis, the improvement comprising:

said inserts having a shape prior to assembly in the sockets that provides a body portion to be received in the sockets and a head portion with an extended crest for contacting said earth formations, said head portion being asymmetrically shaped with said extended crest of said head portion being planar and substantially parallel to said earth formations, said extended crest being at an acute angle to the central axis of said insert.

* * * * *